US012459029B2

(12) United States Patent
Nakazawa et al.

(10) Patent No.: US 12,459,029 B2
(45) Date of Patent: Nov. 4, 2025

(54) PRESS SYSTEM AND CONTROL METHOD OF PRESS SYSTEM

(71) Applicants: AMADA CO., LTD., Kanagawa (JP); AMADA PRESS SYSTEM CO., LTD., Kanagawa (JP)

(72) Inventors: Kazuki Nakazawa, Kanagawa (JP); Akira Utsumi, Kanagawa (JP)

(73) Assignees: AMADA CO., LTD., Kanagawa (JP); AMADA PRESS SYSTEM CO., LTD., Kanagawa (JP)

( * ) Notice: Subject to any disclaimer, the term of this patent is extended or adjusted under 35 U.S.C. 154(b) by 237 days.

(21) Appl. No.: 18/271,500

(22) PCT Filed: Jan. 17, 2022

(86) PCT No.: PCT/JP2022/001337
§ 371 (c)(1),
(2) Date: Jul. 10, 2023

(87) PCT Pub. No.: WO2022/158414
PCT Pub. Date: Jul. 28, 2022

(65) Prior Publication Data

US 2024/0058856 A1 Feb. 22, 2024

(30) Foreign Application Priority Data

Jan. 22, 2021 (JP) ..... 2021-008544

(51) Int. Cl.
*B21D 43/09* (2006.01)

(52) U.S. Cl.
CPC ..... *B21D 43/09* (2013.01)

(58) Field of Classification Search
CPC ..... B21D 22/02; B21D 37/08; B21D 43/08; B21D 43/09; G05B 2219/2622; G05B 2219/45142
See application file for complete search history.

(56) References Cited

U.S. PATENT DOCUMENTS 4,078,416 A * 3/1978 Voorhees ..... B65H 20/04 226/178
5,150,022 A * 9/1992 Waddington ..... B21D 43/09 318/563

(Continued)

FOREIGN PATENT DOCUMENTS

JP 1986-129233 A 6/1986
JP 1987-137130 A 6/1987

(Continued)

OTHER PUBLICATIONS

JP 61-129233A, Yamada et al. Aug. 1986.*

(Continued)

*Primary Examiner* — Edward T Tolan

(57) ABSTRACT

A press system and a control method of the press system that can automatically set a timing for coordinating a press machine and a feeding device. A leveler feeder includes feed rolls that convey a coil material to the press machine in a closed state in which the coil material is clamped, and are brought into an open state in which the coil material is released when stamping by the press machine is started. The press machine includes a sensor for detecting a load F at a time of the stamping, a pilot pin that is inserted into a hole pierced in the coil material for positioning at a time of the stamping, and a controller for controlling the leveler feeder and the press machine so as to perform the stamping in coordination with each other. The controller determines a release start timing Tos (a position Ps+L) at which the feed rolls are switched from the closed state to the open state based on a result of detecting by the sensor as well as a length L of the pilot pin.

10 Claims, 7 Drawing Sheets

(56) References Cited

U.S. PATENT DOCUMENTS

| | | | | |
|---|---|---|---|---|
| 5,392,977 | A * | 2/1995 | Kato | B65H 23/042 72/8.6 |
| 6,619,088 | B1 * | 9/2003 | Oyamada | B30B 1/186 72/21.4 |
| 7,287,678 | B2 * | 10/2007 | Martin | B21D 43/09 83/30 |
| 2004/0079780 | A1 * | 4/2004 | Kato | B21C 47/18 226/24 |

FOREIGN PATENT DOCUMENTS

| | | | |
|---|---|---|---|
| JP | 1992-270017 | A | 9/1992 |
| JP | 1999-047999 | A | 2/1999 |
| JP | 2007-075851 | A | 3/2007 |

OTHER PUBLICATIONS

Translation JP 61-129233A, Yamada et al. Aug. 1986.*
International Search Report for corresponding Application No. PCT/JP2022/001337, mailed Mar. 1, 2022.

* cited by examiner

| POSITION SWITCHES | | | | | |
|---|---|---|---|---|---|
| TOOL X | | | | | |
| | | ON | | OFF | |
| No. | NAME | REGION | POSITION | REGION | POSITION |
| PS1 | SWITCH 1 | DOWN | 80.0 | DOWN | 40.0 |
| PS2 | SWITCH 2 | DOWN | 0.0 | DOWN | 0.0 |
| PS3 | SWITCH 3 | DOWN | 50.0 | DOWN | 20.0 |
| PS4 | SWITCH 4 | DOWN | 6.0 | UP | 6.0 |
| PS5 | SWITCH 5 | DOWN | 0.0 | DOWN | 0.0 |
| PS6 | RELEASE | DOWN | 30.0 | UP | 20.0 |
| PS7 | FEED | UP | 40.0 | DOWN | 40.0 |
| PS8 | INTERFERENCE | DOWN | 60.0 | UP | 0.0 |

PRESS SYSTEM AND CONTROL METHOD OF PRESS SYSTEM

TECHNICAL FIELD

The present invention relates to a press system and a control method of the press system.

BACKGROUND ART

Conventionally, there is a press machine that performs progressive stamping press (hereinafter referred to as progressive stamping). In the progressive stamping, one press die has a plurality of stamping stages to perform several stamping actions (a plurality of steps). A coil material is supplied from an uncoiler, which is installed on an upstream side of the stamping, to the press machine that performs the progressive stamping. A leveler feeder is installed between the uncoiler and the press machine to remove the coil set of the coil material and convey the coil material. In a press system like this, a control is required to convey the coil material in accordance with a stamping operation of the press machine (in other words, a vertical operation of the slide) (see, for example, Patent Literature 1).

The press machine includes a rotary cam switch connected to a rotation of a crankshaft so that the stamping is controlled based on a signal output from the rotary cam switch in synchronization with the stamping operation of the press machine. The signal output from the rotary cam switch is also used to control various timings for operating the press machine and the leveler feeder in coordination with each other. In order to cause the signal to be output from the rotary cam switch at a predetermined timing, a timing for outputting the signal from the rotary cam switch and the stamping operation of the press machine are adjusted manually in accordance with a press die set used in the press machine.

CITATION LIST

Patent Literature

Patent Literature 1: Japanese Patent Application Laid-Open Publication No. 2007-075851

SUMMARY

Technical Problem

However, the timing at which the signal is output from the rotary cam switch (hereinafter referred to as the output timing) is adjusted manually by jogging the press machine or the like. The manual adjustment may be made a plurality of times and may take time. Further, since it is not possible to store information obtained by the adjustment of the output timing of the signal from the rotary cam switch, the adjustment described above may be required each time the press die set is changed. Therefore, the background art has room for improvement from a viewpoint of automation.

The present invention has been made in view of the above circumstances, and an object of the present invention is to provide a press system and a control method of the press system that can automatically set a timing for coordinating a press machine and a feeding device, as an example.

Solution to Problem

In order to solve the above problems, the gist of the present invention is as follows.

(1) A press system including a holding device configured to hold a coil material, a press machine configured to perform progressive stamping press in which several stamping actions are performed in a plurality of stages, and a feeding device configured to feed the coil material held by the holding device to the press machine, in which the feeding device includes rolls configured to convey the coil material to the press machine in a closed state in which the coil material is clamped therebetween and be brought into an open state in which the coil material is released when stamping by the press machine is started, the press machine includes load detection means configured to detect a load at a time of the stamping, a pin configured to be inserted into a hole pierced in the coil material for positioning at the time of the stamping, and control means configured to control the feeding device and the press machine to perform the stamping in coordination with each other, and the control means determines a timing for switching the rolls from the closed state to the open state based on a result of detection by the load detection means and a length of the pin.

(2) A control method of a press system, the press system including a holding device configured to hold a coil material, a press machine configured to perform progressive stamping press in which several stamping actions are performed in a plurality of stages, and a feeding device configured to feed the coil material held by the holding device to the press machine, in which the feeding device includes rolls configured to convey the coil material to the press machine in a closed state in which the coil material is clamped therebetween and be brought into an open state in which the coil material is released when stamping by the press machine is started, the press machine includes load detection means configured to detect a load at a time of the stamping, a pin configured to be inserted into a hole pierced in the coil material for positioning at the time of the stamping, and control means configured to control the feeding device and the press machine to perform the stamping in coordination with each other, and the control method includes determining, by the control means, a timing for switching the rolls from the closed state to the open state based on a result of detection by the load detection means and a length of the pin.

Further objects or other features of the present invention will be made clear by a preferred embodiment described below with reference to the accompanying drawings.

Advantageous Effect of Invention

According to the present invention, it is possible to provide a press system and a control method of the press system that can automatically set a timing for coordinating a press machine and a feeding device.

DESCRIPTION OF EMBODIMENT

Embodiment (Press System)

Figure 1:
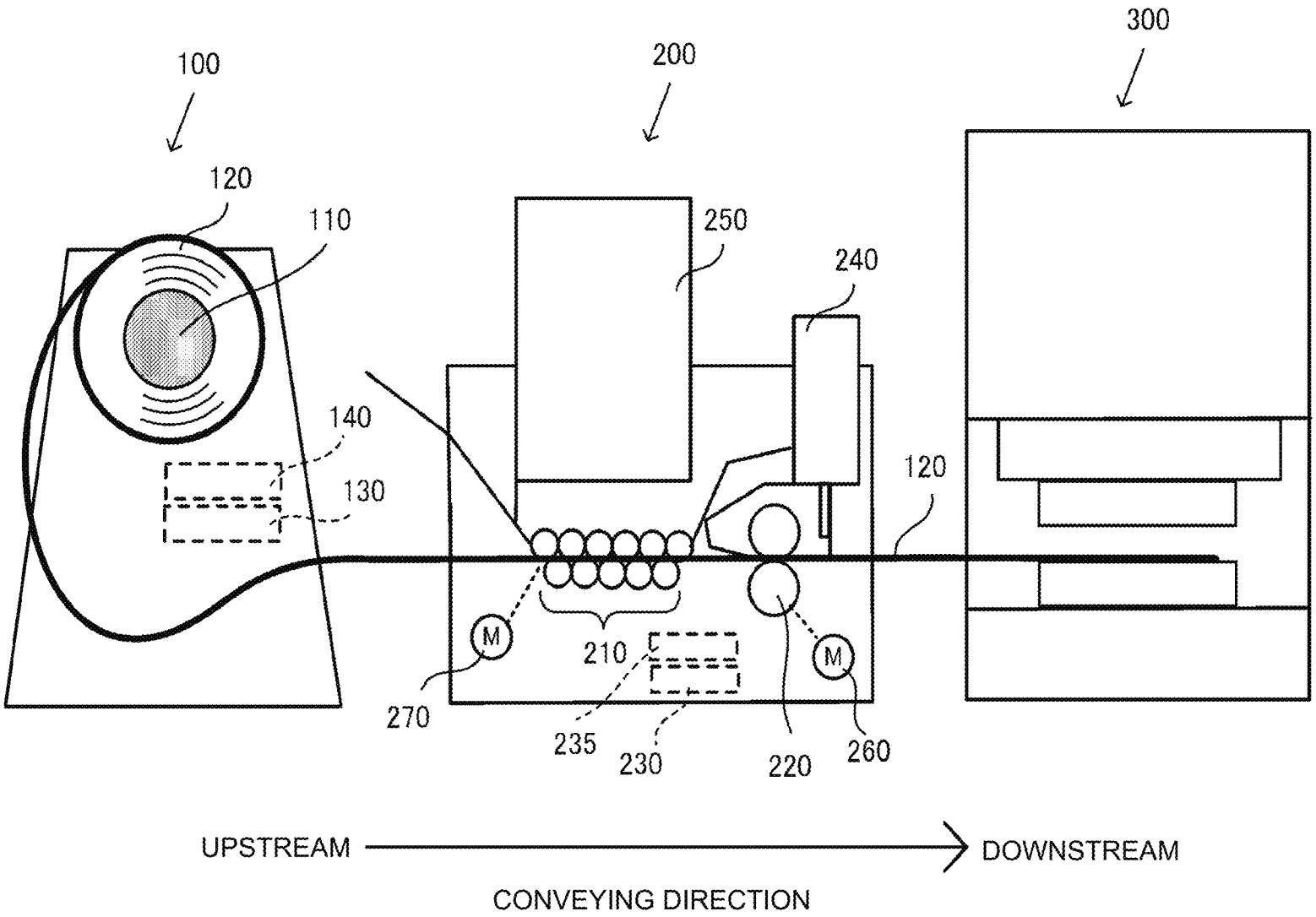
FIG. 1 is a schematic front view showing a structure of a press system of an embodiment.

FIG. 1 is a schematic front view showing a structure of a press system of the present embodiment. FIG. 1 shows a conveying direction as well as an upstream and a downstream. The press system of the present embodiment includes an uncoiler 100, a leveler feeder 200, and a press machine 300. The uncoiler 100 and the leveler feeder 200 operate in coordination with a stamping operation of the press machine 300.

(Uncoiler)

The uncoiler 100, which is a holding device configured to hold a coil material, includes a mandrel 110, a control unit 130, and a driving unit 140. The coil material 120, which is an object to be subjected to the stamping by the press machine 300, is held at the mandrel 110. For example, an inner diameter of the coil material 120 that is wound in a coil shape is held by the mandrel 110. The control unit 130 sets the driving unit 140 to rotate the mandrel 110 so as to coordinate with the stamping operation by the press machine 300, and unwinds the coil material 120.

(Leveler Feeder)

The leveler feeder 200 is a feeding device that feeds, to the press machine 300, the coil material 120 held by the uncoiler 100. The leveler feeder 200 includes a plurality of work rolls 210, feed rolls 220, a control unit 230, a storage unit 235, cylinders 240 and 250, and motors 260 and 270. The work rolls 210 are arranged on an upstream side of the feed rolls 220 in a conveying direction of the coil material 120, brought into a closed state to straighten the coil material 120, and brought into an open state to release the coil material 120. The plurality of work rolls 210 clamp and convey the coil material 120 unwound by the uncoiler 100, thereby functioning as straightening means configured to gradually remove the coil set of the coil material 120 from the upstream side toward a downstream side in the conveying direction of the coil material 120. The feed rolls 220 (rolls) function as feeding means configured to feed, to the press machine 300, the coil material 120 straightened by the work rolls 210. The feed rolls 220 convey the coil material 120 to the press machine 300 in a closed state in which the coil material 120 is clamped therebetween, and are brought into an open state in which the coil material 120 is released when the stamping by the press machine 300 is started.

The cylinder 240 switches between the closed state in which the feed rolls 220 clamp the coil material 120 therebetween and the open state in which the feed rolls 220 does not clamp the coil material 120 therebetween. The cylinder 250 switches between a state in which the work rolls 210 clamp the coil material 120 to remove the coil set thereof and a state in which the work rolls 210 do not clamp the coil material 120. As to the work rolls 210, in the same manner as the feed rolls 220, the state in which the coil material 120 is clamped therebetween is referred to as the closed state, and the state in which the coil material 120 is not clamped therebetween is referred to as the open state. Note that switching the feed rolls 220 from the closed state to the open state by the cylinder 240 and maintaining the open state is hereinafter referred to as a release. Further, switching the work rolls 210 from the closed state to the open state by the cylinder 250 and maintaining the open state are also referred to as the release. A motor 260 drives a rotation of the feed rolls 220. The motor 270 drives a rotation of the work rolls 210.

The control unit 230 controls the cylinder 250 and the motor 270 in coordination with an operation of the uncoiler 100 to remove the coil set of the coil material 120. The control unit 230 feeds out the coil material 120 to the press machine 300 by controlling the cylinder 240 and the motor 260 as well as the cylinder 250 and the motor 270 in coordination with an operation of the press machine 300. Note that it is assumed that the control unit 230 controls a rotation control of the work rolls 210 and the feed rolls 220 by a known method using a detection means such as an encoder, for example. In a similar manner, it is assumed that the control unit 230 controls a switching control between the open state and the closed state of the work rolls 210 and the feed rolls 220 by a known method.

Note that in the present embodiment, although the work rolls 210 are driven by the motor 270 and the feed rolls 220 are driven by the motor 260, the present invention is not limited to this. For example, the work rolls 210 and the feed rolls 220 may be driven by one motor.

The control unit 230 controls the leveler feeder 200, while being coordinated with the press machine 300, in accordance with various programs stored in the storage unit 235. The storage unit 235 stores, for example, a velocity at which the coil material 120 is conveyed (hereinafter referred to as a standard feed velocity) and a fast feed velocity faster than the standard feed velocity. The control unit 230 conveys the coil material 120 at the standard feed velocity or the fast feed velocity in accordance with a stamping speed of the press machine 300.

Note that in the present embodiment, it is assumed that the coil material 120 is conveyed at the standard feed velocity or the fast feed velocity in accordance with the stamping speed of the press machine 300, but the present invention is not limited to this. For example, there is a case in which a mode of conveying the coil material 120 at the fast feed velocity can be selected for a material below the maximum specification of a straightening capability of the work roll 210. In this case, since a time (a feed time) for conveying the coil material 120 by a feed length is shortened, it is possible to increase a rotational speed of the press machine 300. Therefore, the controller 314 may change the stamping speed on a side of the press machine 300 in accordance with the feed velocity on a side of the leveler feeder 200. Further, three or more types of feed velocities may be stored in the storage unit 235. After the coil material 120 has been conveyed by a work length that will be described later, the control unit 230 stops the conveying operation (the feed ended).

Note that the leveler feeder 200 may include a display unit and an input unit. Further, although a description has been given in FIG. 1 of one leveler feeder 200 including a leveler for removing the coil set of the coil material and a feeder for feeding, to the press machine, the coil material whose coil set has been removed by the leveler, the press system may include each of them as an individual device.

(Press Machine)

Figure 2:
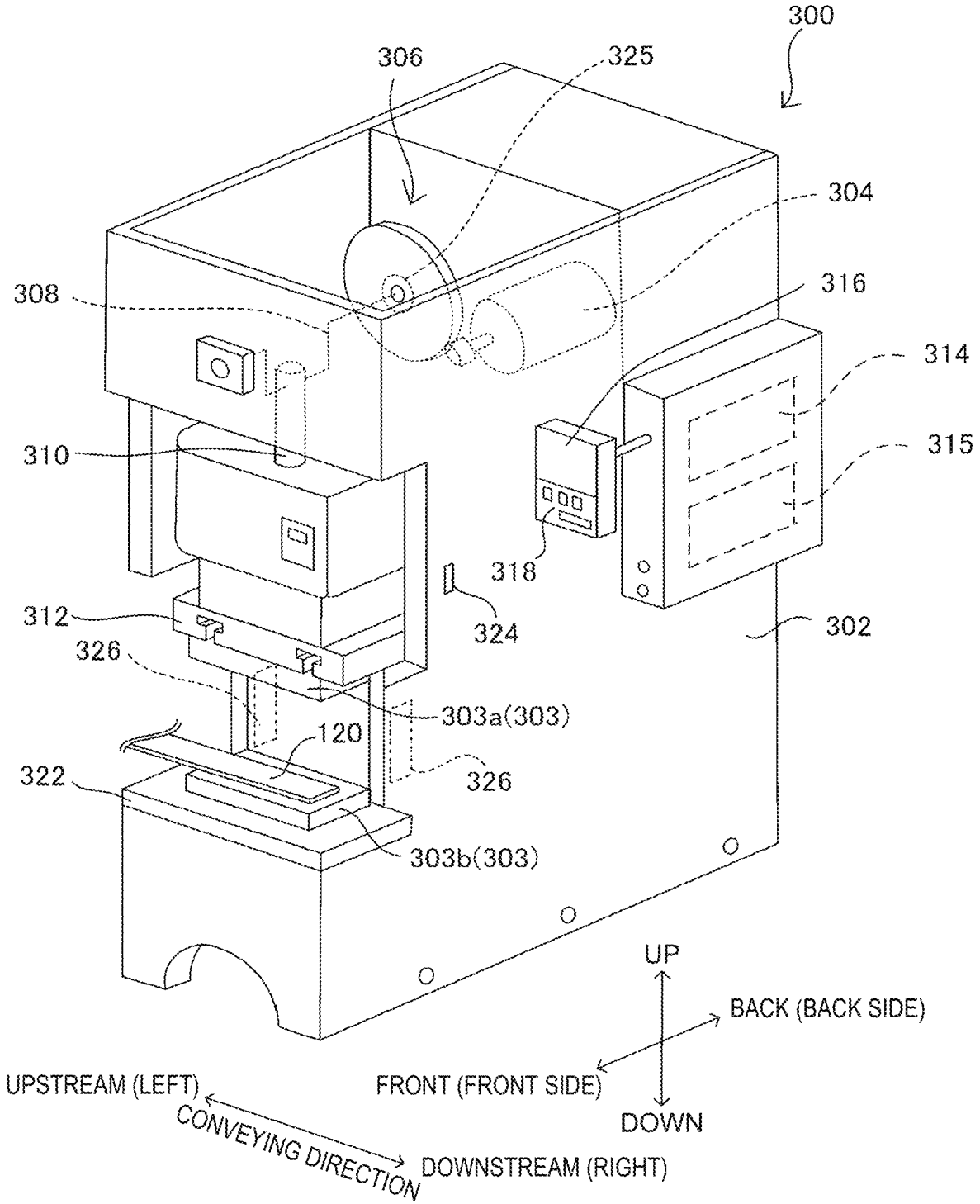
FIG. 2 is a schematic perspective view showing a structure of a press machine of the embodiment.

The press machine 300 in FIG. 1 will be described by use of FIG. 2. FIG. 2 is a schematic perspective view showing a structure of the press machine 300 of the present embodiment, for example, the schematic view of the press machine 300 of a straight-side one-piece frame type or of a C-frame type. Further, the press machine 300 is, for example, a device that performs progressive stamping press in which several stamping actions are performed in a plurality of stages. FIG. 2 shows the conveying direction of the coil material 120, the upstream, the downstream, a vertical direction, and a longitudinal direction (a front side and a back side) in the conveying direction. The press machine 300 is configured to include a drive motor 304 (a driving means), a transmission mechanism 306, a crankshaft 308, a connecting rod 310, a slide 312, and a bolster 322 inside and outside of a housing 302. Further, the press machine 300 includes a controller 314 that is a controlling means, a storage unit 315, a display unit 316, and an input unit 318. Furthermore, the press machine 300 includes a sensor 324, a rotary encoder 325, and guide gibs 326. The press machine 300 of the present embodiment is the press machine of a progressive type that performs the progressive stamping press (hereinafter referred to as the progressive stamping), and has a plurality of stamping stages.

The drive motor 304 is, for example, a servo-controlled servomotor that vertically moves a press die 303, which will be described later, via the transmission mechanism 306, the crankshaft 308, and the connecting rod 310 while controlling a rotational amount and a rotational direction. The transmission mechanism 306 is configured to include transmission members such as a gear and a belt, for example, and transmits a rotation of a motor shaft of the drive motor 304 to the crankshaft 308. A control signal to the drive motor 304 is sent from the controller 314.

The crankshaft 308 and the connecting rod 310 are for converting a rotational movement of the motor shaft, which is transmitted by the transmission mechanism 306, into a reciprocating movement (a vertical movement in the present embodiment). The rotation of the motor shaft sets the crankshaft 308 to rotate, and the rotation is transmitted to the connecting rod 310 having a vicinity of one end connected to the crankshaft 308 so as to vertically move (to move in an ascending and descending manner) the connecting rod 310.

Further, the crankshaft 308 is provided with a rotary cam switch (not shown) that outputs an ON signal or an OFF signal in coordination with the rotation of the crankshaft 308. The rotary cam switch outputs the ON signal or the OFF signal when, for example, the rotation of the crankshaft 308 reaches a predetermined angle, in other words, reaches a predetermined timing during the stamping operation. A timing at which the rotary cam switch outputs the ON signal (or the OFF signal) is hereinafter referred to as an output timing. The controller 314 performs the stamping operations in coordination with the uncoiler 100 and the leveler feeder 200 based on the signal output from the rotary cam switch. Conventionally, it is necessary to manually adjust (or set) the output timing of the signal of the rotary cam switch in advance for each press die.

A slide 312 is connected to a vicinity of the other end of the connecting rod 310. As the connecting rod 310 vertically moves, the slide 312 vertically moves along the guide gibs 326. In the press machine 300, a bolster 322 is arranged so as to face the slide 312. An upper die 303*a* is mounted as a part of the press dies 303 to a surface of the slide 312 on a side facing the bolster 322 (a lower surface in the present embodiment). A lower die 303*b* that forms a pair with the upper die 303*a* is mounted as a part of the press dies 303 to a surface of the bolster 322 on a side facing the slide 312 (an upper surface in the present embodiment).

The coil material 120 as the object to be subjected to the stamping is arranged between the upper die 303*a* and the lower die 303*b*, and pressed by the upper die 303*a* and the lower die 303*b*. Thereby, the stamping press is performed to the coil material 120 by the press machine 300. The coil material 120 is conveyed, for example, from the left (upstream) side to the right (downstream) side in FIG. 2. Hereinafter, the conveying direction of the coil material 120 is also referred to as the lateral direction. In the stamping press including the plurality of steps, stamping in an early stage is performed from the upstream in the conveying direction of the coil material 120, and stamping in a final stage is performed in the downstream in the conveying direction of the coil material 120.

Specifically, the drive motor 304 rotates under the control of the controller 314. The rotation of the drive motor 304 is transmitted to the connecting rod 310 via the transmission mechanism 306 and the crankshaft 308 so that the slide 312 vertically moves. The upper die 303*a* and the lower die 303*b* are pressed by a downward movement of the slide 312, which performs the stamping press of the coil material 120. In other words, in the press machine 300, the drive motor 304, the transmission mechanism 306, the crankshaft 308, the connecting rod 310, and the slide 312 constitute a press unit. The transmission mechanism 306 is provided with the rotary encoder 325 that is rotational speed detection means configured to detect a rotational speed of the crankshaft 308. The controller 314 can detect a position of the slide 312 by detecting the rotational speed of the crankshaft by way of the rotary encoder 325.

The sensor 324, which is load detection means configured to detect a load during the stamping, is a sensor for detecting a load F (see FIG. 5) acting on the connecting rod 310 when the press machine 300 performs the stamping press to the coil material 120. The sensor 324 is, for example, a load cell. The sensor 324 may be, for example, a strain gauge installed on the housing 302. The sensor 324 may be installed at any position on the connecting rod 310 (for example, at a position in a vicinity of a center thereof). Furthermore, a plurality of sensors 324 may be installed. For example, strains on the left and right of the housing 302 may be respectively detected, and the results of detection may be added to obtain the total load F. Note that in FIG. 2, a side on which the display unit 316 is arranged is the front side of the press machine 300.

The controller 314 controls the press machine 300 in accordance with various programs stored in the storage unit 315. The display unit 316 displays data that indicate a state of the press machine 300. The input unit 318 is used to input data necessary to operate the press machine 300. The input unit 318 is used when a user inputs a length of a pilot pin, a feed timing set value, an interference timing set value, a length of conveying the coil material 120 (hereinafter also referred to as the work length or the feed length), and the like, which will be described later. Note that the work length is, for example, a length in the conveying direction of the stamping stage. The controller 314 controls the leveler feeder 200 and the press machine 300 to perform the stamping in coordination with each other. In the press machine 300 that performs the progressive stamping, when the stamping in one stamping stage is ended, the controller 314 controls the leveler feeder 200 to convey the coil material 120 to the next stamping stage by a predetermined feed length at a predetermined feed velocity.

(Press Die)

Figure 3:
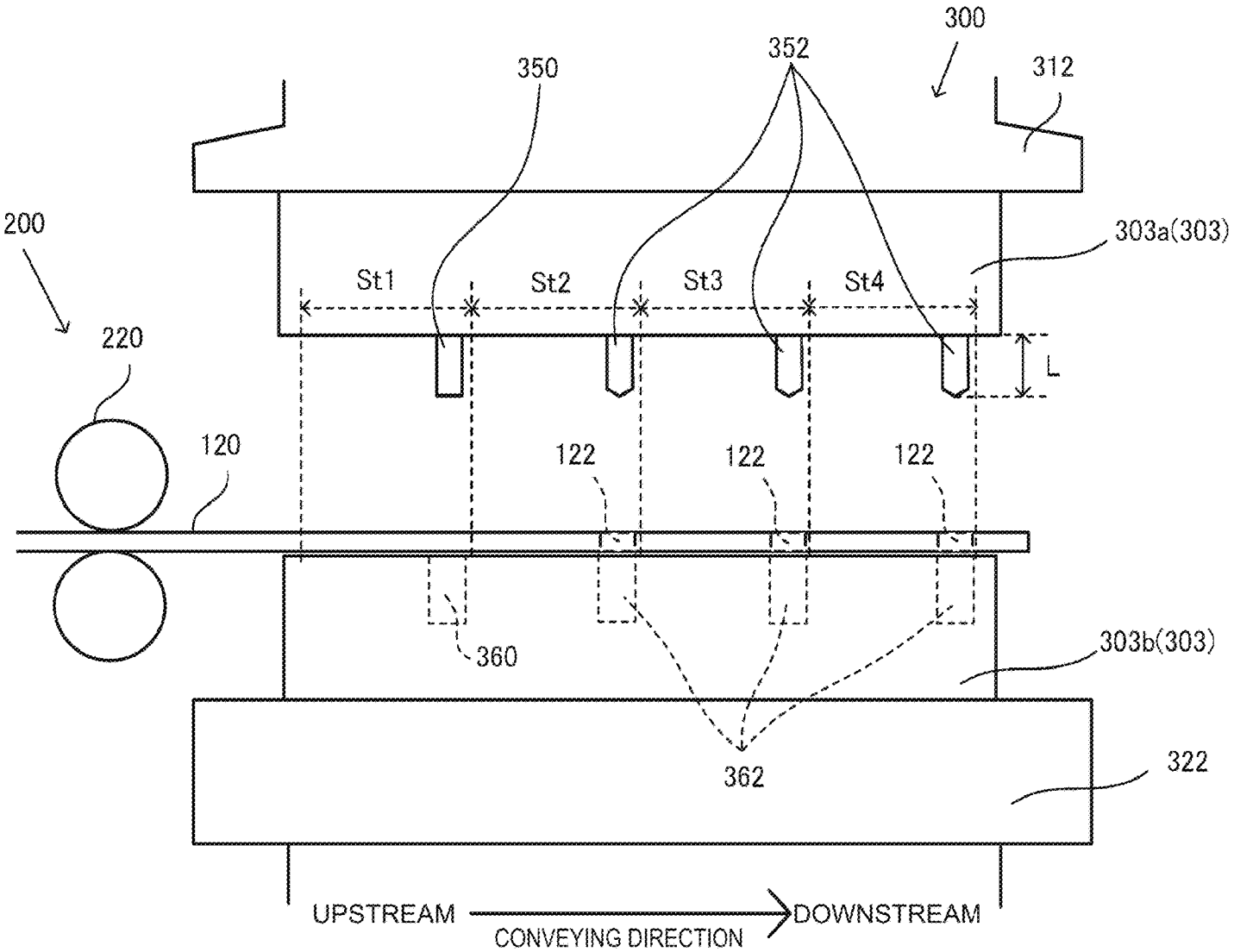
FIG. 3 is a schematic front view showing a structure of a press die set that performs progressive stamping press of the embodiment.

FIG. 3 is a schematic front view showing a structure of the press die set that performs the progressive stamping press of the present embodiment, and particularly the schematic diagram illustrating the press dies 303 (the upper die 303*a* and the lower die 303*b*) included in the press machine 300 of the present embodiment. The press machine 300 of the present embodiment performs the plurality of various stamping actions (the plurality of steps) such as coining, restriking, shaving, ironing, and piercing with one set of the press dies 303. In the press dies 303, a portion (range), in which one stamping action is performed, is referred to as a stamping stage. The press dies 303 shown in FIG. 3 include, for example, four stamping stages of St1, St2, St3, and St4 from the upstream side in the conveying direction.

In the stamping stage St1, a punch 350 is provided on the upper die 303*a*. A die 360 is provided on the lower die 303*b* at a position facing the punch 350. The punch 350 and the die 360 pierce a pilot hole 122 at a portion of the coil material 120 to be scrapped (hereinafter referred to as a scrap portion), for example, when stamping in the stamping stage St1 is performed. The pilot hole 122 is a hole into which a pilot pin 352 for positioning the press dies 303 and the coil material 120 during the stamping operation is inserted.

In the stamping stages St2 to St4, the pilot pins 352 are provided on the upper die 303*a*. The dies 362 are provided on the lower die 303*b* at positions facing the pilot pins 352, respectively. When the stamping in the stamping stages St2 to St4 is performed, the pilot pins 352 (the pins) are inserted into the pilot holes 122 (the holes) pierced in the coil material 120 so as to position the press dies 303 and the coil material 120 during the stamping operation. The length of the plurality of (three in FIG. 3) pilot pins 352 is set to be a same length L, for example. The length L of the pilot pin 352 differs for each press die 303. Note that the length L of the pilot pin 352 is the length from a lower surface of the upper die 303*a* to a tip of the pilot pin 352.

(Block diagram of Press System)

Figure 4:
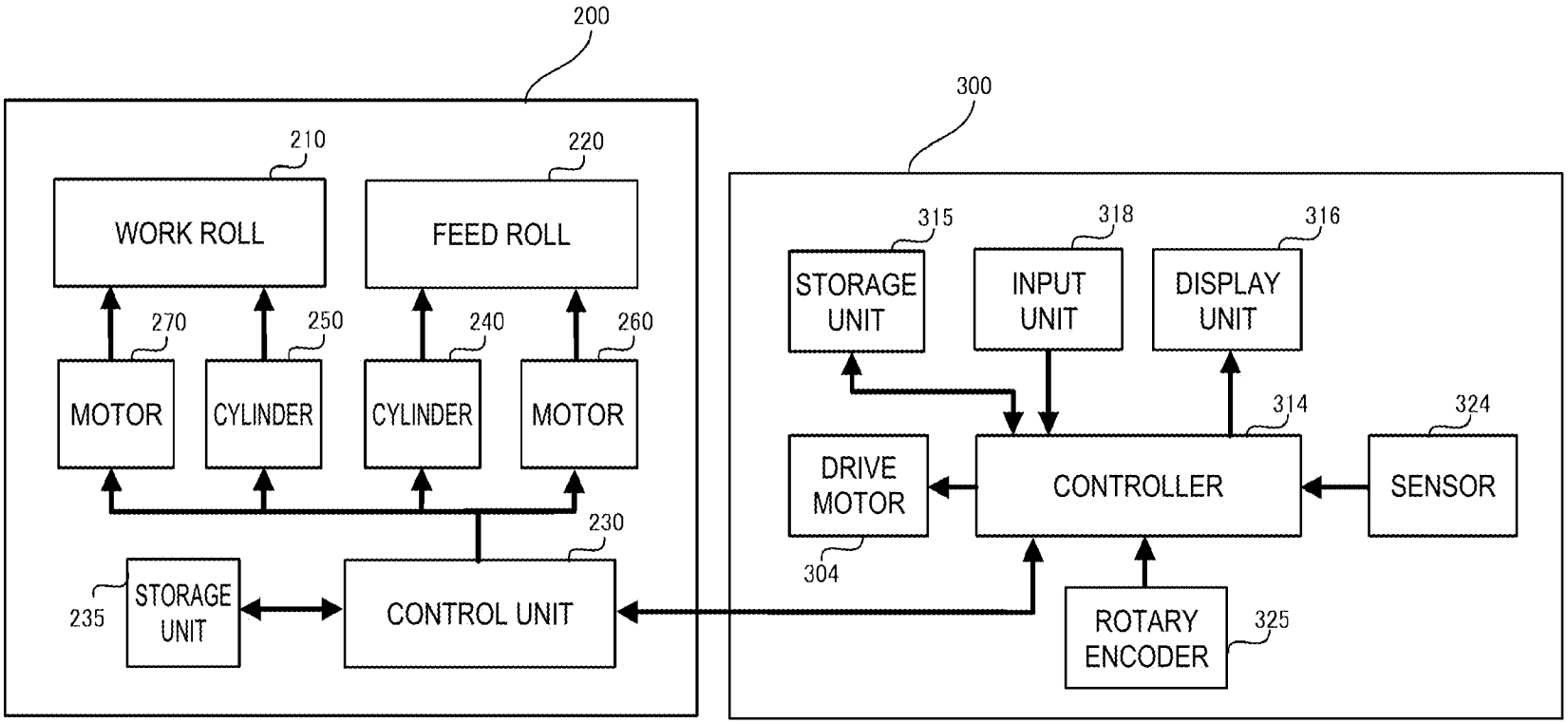
FIG. 4 is a block diagram of the press machine and a leveler feeder of the embodiment.

FIG. 4 is a block diagram of the press system of the present embodiment, and particularly shows the block diagram of the leveler feeder 200 and the press machine 300. The control unit 230 of the leveler feeder 200 controls the motor 260 to rotate the feed rolls 220. Further, the control unit 230 controls the cylinder 240 to switch between the open state and the closed state of the feed rolls. The control unit 230 controls the motor 270 to rotate the work rolls 210. Further, the control unit 230 controls the cylinder 250 to control the straightening operation of the coil material 120 by the work rolls 210 and the switching between the open state and the closed state. The storage unit 235 stores various pieces of information, programs, and the like necessary for the control unit 230 to control the leveler feeder 200.

The controller 314 of the press machine 300 controls the drive motor 304. The controller 314 is also connected to the display unit 316 and the input unit 318. The controller 314 reads various parameters, the various programs, and the like stored in the storage unit 315 in advance, and controls the stamping operation of the press machine 300 based on these. Further, setting information of the timing, which will be described later, is stored in the storage unit 315. The rotary encoder 325 detects a rotational speed of an output shaft (not shown) of the drive motor 304 and outputs a result of detection to the controller 314. The controller 314 controls the drive motor 304 based on the results of detection by the rotary encoder 325. Further, by way of the sensor 324, the controller 314 detects the load F generated during the stamping.

The controller 314 of the press machine 300 and the control unit 230 of the leveler feeder 200 can transmit and receive the various pieces of information to and from each other by a known communication method, for example, via a communication port (not shown) included in each of the devices.

(Timing Necessary to Coordinate Press Machine and Leveler Feeder)

In order for the press machine 300 and the leveler feeder 200 to perform the stamping operation in coordination with each other, it is necessary to control a timing during the stamping operation. It is necessary for the control unit 230 of the leveler feeder 200 to convey the coil material 120 to the next stamping stage at a timing at which the coil material 120 and the press dies 303 of the press machine 300, particularly, the pilot pin 352 protruding downward from the upper die 303*a*, do not interfere with each other. Further, it is necessary for the control unit 230 to release the work rolls 210 and the feed rolls 220 at a timing at which the pilot pin 352 is inserted into the pilot hole 122. The present embodiment is characterized in that the controller 314 determines a timing at which the feed rolls 220 are switched from the closed state to the open state based on the result of detection by the sensor 324 and the length L of the pilot pin 352.

By releasing the work rolls 210 and the feed rolls 220, the coil material 120 is brought into a free state, which makes it possible to modify a position and a direction of the coil material 120 with respect to the press dies 303 when the pilot pin 352 is inserted into the pilot hole 122. A command transmitted by the controller 314 to the control unit 230 to release the work rolls 210 and the feed rolls 220 is hereinafter referred to as a release command. In the present embodiment, the release of the feed rolls 220 will be described.

A range from a start of the release (the switching from the closed state to the open state) to an end of the release (the switching from the open state to the closed state) is determined based on a position (a height) of the slide 312 at which the pilot pin 352 start to be inserted into the pilot hole 122 and a bottom dead center. Note that when the press machine 300 includes a stripper (not shown), the end of the release is determined based on a position at which the stripper is separated from the coil material 120. Note that conventionally, in order to set the timing at which the feed rolls 220 are released (hereinafter referred to as a release timing), the press machine 300 is manually adjusted in advance by inching the press machine 300.

Further, a command is transmitted by the controller 314 to the control unit 230 to convey the coil material 120 when a stamping process by the press machine 300 is ended and the coil material 120 is conveyed to the next stamping stage by the leveler feeder 200. The command is hereinafter referred to as a feed command. A timing at which the feed command is transmitted (hereinafter referred to as a feed timing) is set based on a height (a position) of the slide 312 at which the feed rolls 220 are brought into the closed state and the slide 312 (in other words, the press die 303, particularly the pilot pin 352) is raised after a stamping process by the press machine 300 is ended, which makes it possible to convey the coil material 120 without interfering with the coil material 120. For example, the feed timing is set based on the height of the slide 312 when the pilot pin 352 is completely removed from the pilot hole 122, which is pierced in the coil material 120, after a stamping process is ended.

Furthermore, even while the coil material 120 is being conveyed by the leveler feeder 200, on the side of the press machine 300, the slide 312 changes from an upward movement to a downward movement and continues the downward movement for the next stamping. Therefore, it is necessary for the conveyance of the coil material 120 by the leveler feeder 2 to be ended before for example, a portion of the coil material 120 on which stamping has been ended in the stamping stage St1 is conveyed to the next stamping stage St2 and the pilot pin 352 starts to be inserted into the pilot hole 122. In order to prevent the conveyance of the coil material 120 at this time from interfering with the slide 312, specifically, the pilot pin 352, the controller 314 outputs a signal to the control unit 230. Hereinafter, the signal is referred to as the interference signal. At a timing at which the controller 314 outputs the interference signal to the control unit 230 (hereinafter referred to an interference timing), the slide 312 needs to be at a position that is further higher by the length L of the pilot pin 352, when a position of the slide 312 when the stamping is started (corresponding to a timing Ts, which will be described later) is used as a reference. Note that for the interference timing, the position of the slide 312 when the stamping is started is used as the reference, but the present invention is not limited to this. For example, a position of the slide 312 at the release timing described above (corresponding to a timing Tos, which will be described later) may be used as the reference.

Here, when the position of the slide 312 corresponding to the interference timing becomes higher, a range in which the coil material 120 can be conveyed (hereinafter referred to as a feedable range) becomes smaller. In this case, it is necessary to lower the rotational speed of the crankshaft 308 of the press machine 300 in order to widen the feedable range. In this manner, it is necessary to control the stamping operation (for example, the rotational speed of the crankshaft 308 and the like) on the side of the press machine 300 in accordance with the respective timings of the conveyance of the coil material 120.

(Setting Method of Respective Timings of Present Embodiment)

Figure 5A:
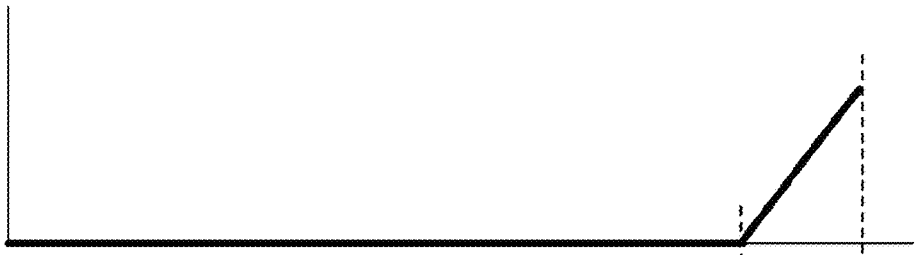
FIG. 5(*a*) is a graph showing a feed of the leveler feeder, FIG. 5(*b*) is a graph showing a load and a position of a slide, and FIG. 5(*c*) is a diagram showing a relation between a rotation of a crankshaft and a control operation of the embodiment.
Figure 5B:
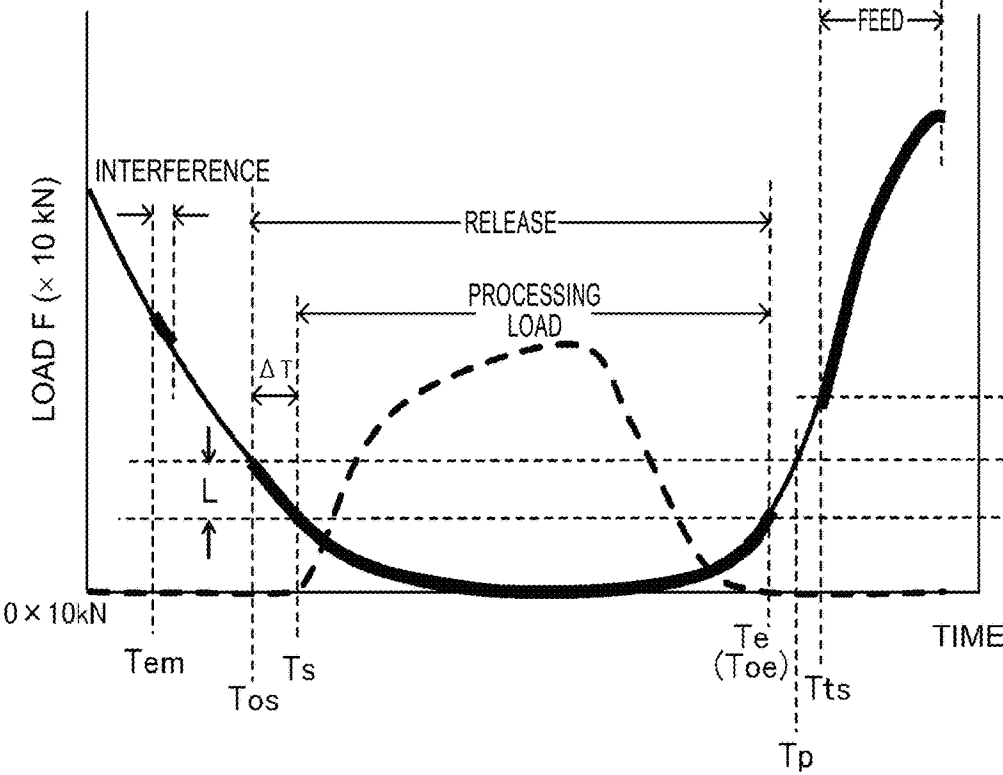
Figure 5C:
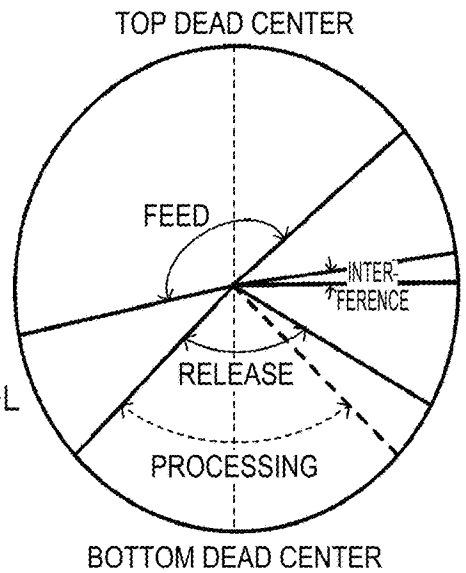

In order to set the respective timings, the stamping operation is performed once by the press machine 300 on which the predetermined press dies 303 are installed. The controller 314 detects the load F during the stamping operation by way of the sensor 324. The controller 314 determines that the stamping is started when the sensor 324 starts to detect the load F, and determines that the stamping is ended when the sensor 324 no longer detects the load F. FIG. 5(*a*) is a graph showing a feed of the leveler feeder 200 of the present embodiment, and FIG. 5(*b*) is a graph showing the load F and the position of the slide 312. In FIG. 5(*b*), the broken line indicates a result in which the load F [×10 kN] during the stamping operation is detected by the sensor 324, and the solid line indicates the position [mm] of the slide 312 based on a result detected by the rotary encoder 325. The position of the slide 312 uses a bottom dead center (0 mm) as a reference. The horizontal axis indicates a time.

The controller 314 stores the load F and the time (the timing) detected by the sensor 324 in the storage unit 315 while the one stamping operation is being performed. Further, the controller 314 stores the position (the height) and the time (the timing) of the slide 312 in the storage unit 315 based on a result detected by the rotary encoder 325 while the one stamping operation is being performed.

The controller 314 can determine at which timing (or position) the press dies 303 have started the stamping and at which timing (or position) the press dies 303 have ended the stamping by analyzing a waveform of the load F (hereinafter referred to as a load waveform) obtained by the one stamping action. For example, in the load waveform of FIG. 5, the controller 314 determines, from a rise of the load waveform, the timing Ts at which the stamping is started, and determines, from a timing at which the load waveform becomes 0 [×10 kN], a timing Te at which the stamping is ended. From this, it can be seen that from the timing Ts to the timing Te is a range in which the load due to the stamping (the stamping load) is applied.

(Release Timing)

The controller 314 determines a position Ps of the slide 312 at the timing Ts. Here, at the timing Ts at which the stamping is started, the pilot pin 352 is inserted into the pilot hole 122. It is necessary for a timing at which the release of the feed rolls 220 is started (hereinafter referred to as a start timing) to be before the pilot pin 352 starts to be inserted into the pilot hole 122, and it is preferable that the start timing is immediately before the pilot pin 352 starts to be inserted into the pilot hole 122.

In other words, the start timing of the release of the feed rolls 220 may be a timing Tos at which the slide 312 is at a position (Ps+L) higher than the position Ps by the length L of the pilot pin 352. The controller 314 sets the start timing of the release of the feed rolls 220 to a timing Tos (=Ts−ΔT) obtained by subtracting a time corresponding to the length L of the pilot pin 352 (hereinafter referred to as ΔT) from the timing Ts.

Release start timing Tos=timing Ts−ΔT

The controller 314 sets, to a timing Te, a release end timing (hereinafter referred to be as an end timing) Toe of the feed rolls 220.

Release end timing Toe=Timing Te Note that the slide 312 at the timing Te is at a position Pe. From the above, a range of the release command is from the timing Tos to the timing Toe, and the controller 314 of the press machine 300 transmits the release command to the control unit 230 of the leveler feeder 200 to release (maintain the open state of) the feed rolls 220 from the timing Tos to the timing Toe. From the timing Tos to the timing Toe is a range in which the feed rolls 220 are released.

Note that, as shown in FIG. 5(*b*), since the timings can be converted to the positions of the slide 312, the positions of the slide 312 are used as the set values in actual control. For example, it is assumed that the position Ps of the slide 312 at the stamping start timing Ts is 20 mm, the position Pe of the slide 312 at the stamping end timing Te is 20 mm, and the length L of the pilot pin 352 is 10 mm. Then, the position of the slide 312 is 30 mm (=20 mm+10 mm) at the release start timing and 20 mm at the release end timing. As described above, the controller 314 sets a first timing, at which the feed rolls 220 are switched from the closed state to the open state before the stamping is started, to a timing at which a height when the slide 312 is descending is a height obtained by adding the length L of the pilot pin 352 to a height when the stamping is started. Further, the controller 314 sets a timing, at which the feed rolls 220 are switched from the open state to the closed state after the stamping is ended, to a timing at which a height when the slide 312 is ascending is a height when the stamping is ended.

(Feed timing)

Since the slide 312 is at the position Pe at the stamping end timing Te and the pilot pin 352 is not removed from the pilot hole 122, it is not possible to convey the coil material 120. It is at the timing Tp at which the slide 312 is at a position (Pe+L) higher than the position Pe by the length L of the pilot pin 352 that the pilot pin 352 is removed from the pilot hole 122. At and after the timing Tp, it is possible for the leveler feeder 200 to convey the coil material 120 to the next stamping stage. Here, a start timing of the feed command is Tts, and a position of the slide 312 at that time is Pts.

In the present embodiment, the controller 314 adds a predetermined set value (hereinafter referred to as a feed timing set value) to the release end timing Toe in consideration of a margin so that the timing Tts is the timing later than the timing Tp.

Feed Start Timing Tts=Timing Toe+Feed Timing Set Value

In a similar manner as the respective timings of the release, in order to perform control by the positions of the slide 312, it is assumed that the feed timing set value (a first value) is 20 mm, for example. Then, the position Pts of the slide 312 is 40 mm (=20 mm+20 mm) at the feed start timing Tts. As described above, the controller 314 sets the timing, at which conveyance of the coil material 120 is started by the feed rolls 220 after the stamping is ended, to be later than the timing at which the feed rolls 220 are switched from the open state to the closed state. Further, the controller 314 sets a timing, at which the conveyance of the coil material 120 is started by the feed rolls 220 after the stamping is ended, to a timing obtained by adding the first value to a position of the slide 312 when the stamping is ended.

As shown in FIG. 5(*a*), the conveyance of the coil material 120 by the feed rolls 220 is stared at the timing Tts, and the conveyance of the coil material 120 by the feed rolls 220 is ended when the coil material 120 is conveyed by a preset feed length.

(Interference Timing)

In a predetermined stamping stage, it is imperative for the conveyance of the coil material 120 by the leveler feeders 200 to be ended by a timing Tem that is before the release start timing Tos. If the conveyance of the coil material 120 by the leveler feeder 200 is not ended by the timing Tem, the coil material 120 and the press dies 303 are likely to interfere with each other to cause a problem. When the conveyance of the coil material 120 is not ended by the timing Tem, the controller 314 outputs a signal (hereinafter referred to as a sudden stop signal) so as to stop the press system in a safe manner. Here, to stop the press system in a safe manner means to stop the press system in a state in which the pilot pin 352 and the coil material 120 are not in contact with each other, for example. The timing Tem at which the controller 314 outputs the sudden stop signal is set in consideration of a time margin that enables the press machine 300 to actually stop in a safe manner after the signal is output.

The timing Tem is hereinafter referred to as an interference timing. The interference timing Tem is set to a timing at which the press system can be stopped in a safe manner, that is, a timing prior to the timing Tos. For example, the controller 314 sets the interference timing to a value obtained by subtracting a predetermined set value (hereinafter referred to as an interference timing set value) from the stamping start timing Ts in consideration of a margin.

Interference Timing Tem=Timing Ts−Interference Timing Set Value

In a similar manner as the respective timings of the release, in order to perform control by the positions of the slide 312, it is assumed that the interference timing set value (a second value) is 40 mm, for example. Then, the position of the slide 312 is 60 mm (=20 mm+40 mm) at the interference timing. As described above, the controller 314 outputs a signal when the pilot pin 352 and the coil material 120 are likely to interfere with each other in a state in which the conveyance of the coil material 120 by the feed rolls 220 is not ended. The controller 314 sets a timing, at which the signal is output, to a timing obtained by adding the second value to a position of the slide 312 at the first timing.

Note that as described above, when the interference timing is set, the timing Tos (the position Ps of the slide 312+L) may be used as the reference or the timing Ts (the position Ps of the slide 312) may be used as the reference. When the timing Tos (the position Ps of the slide 312+L) is used as the reference, the length L of the pilot pin 352 is not included in the interference timing set value. On the other hand, when the timing Ts (the position Ps of the slide 312) is used as the reference, the length L of the pilot pin 352 is included in the interference timing set value.

(Regarding Interference Timing Set Value (Second Value))

Here, the interference timing set value will be described. When the interference timing is provided to prevent interference, two cases can be considered in which the "interference" here may mean interference between the coil material 120 and the press dies 3 at a position at which the stamping is stared, or interference between the pilot pin 352 and the coil material 120. If the pilot pin 352 is included as in the present embodiment, the position or the timing (=Tos) of the slide 312 when the interfere between the pilot pin 352 and the coil material 120 is started is used as a position at which the interference is started (hereinafter referred to as an interference position) or a timing at which the interference is started. On the other hand, if the pilot pin is not included in the press die or if the length of the pilot pin 352 is unknown, the position or the timing (=Ts) of the slide 312 when the stamping is started is used as the interference position or the timing at which the interference is started.

Figure 6A:
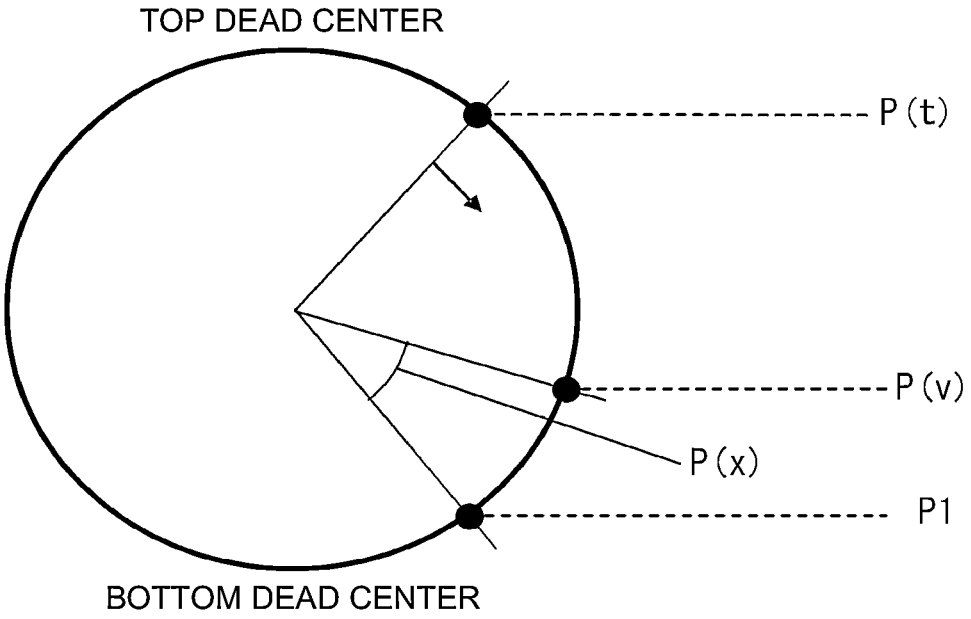
FIG. 6(*a*) is a diagram illustrating each value when an interference timing set value is determined, and FIG. 6(*b*) is a graph showing a relation between a time and a feed velocity at a time of sudden stop processing of the embodiment.
Figure 6B:
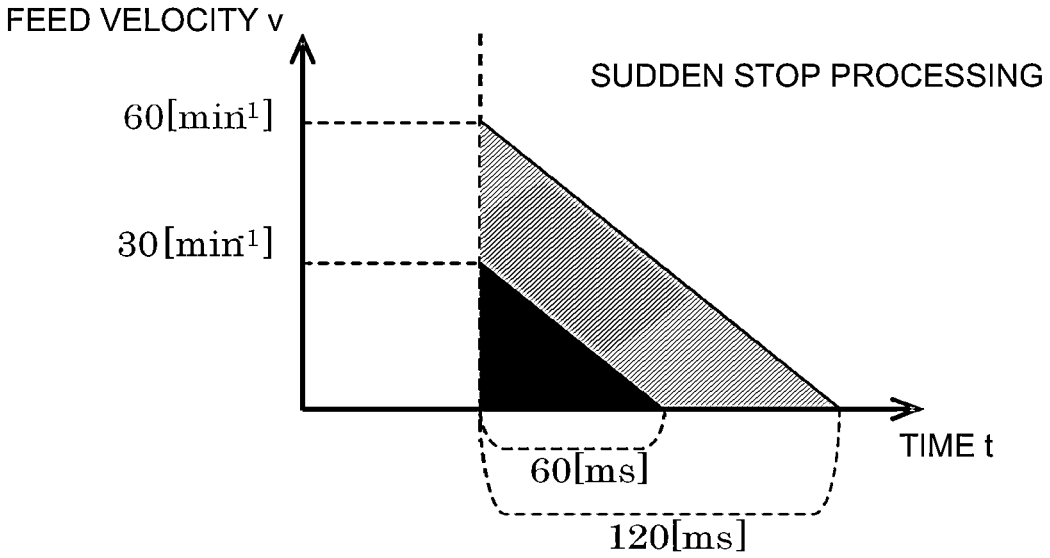

The concept of using, as the interference timing set value, a deceleration moving angle that can be applied to both of these two interference timings (Ts, Tos), will be described by use of FIG. 6. FIG. 6(*a*) is a diagram illustrating each value when the interference timing set value (in other words, the deceleration moving angle) is determined, and FIG. 6(*b*) is a graph showing a relation between a time and a feed velocity at the time of the sudden stop processing.

As shown in FIG. 6(*a*), in the following description, a position of the slide 312 at a time t (hereinafter referred to as a slide position) is set to P(t), and a position at which a determination (a checking) of whether or not to stop the press machine 300 and the leveler feeder 200 as the interference is expected to occur (hereinafter, referred to as an interference check position) when the feed velocity v [$min^{-1}$] is set to P(v). Further, a movement distance from when the controller 314 outputs the sudden stop signal to the press machine 300 and the leveler feeder 200 to when the stamping operation of the press machine 300 and the feeding operation of the leveler feeder 200 decelerate and stop, in other words, a moving angle are decelerated and stopped, in other words, a moving angle is set to a deceleration moving angle P(x) [deg]. Here, x indicates that the deceleration moving angle is a variable that correlates with a current speed and a deceleration time. Further, the deceleration time for the feed velocity v is set to T(v) [ms]. Note that the deceleration time T(v) differs for each of the press machines 300. Furthermore, the interference position is set to P1.

The controller 314 constantly monitors the slide position P(t), and outputs the sudden stop signal as an error to the press machine 300 and the leveler feeder 200 to cause them to suddenly stop when the controller 314 determines that the feeding operation of the coil material 120 by the leveler feeder 200 is not completed before the slide position P(t) passes the interference check position P(v). The interference check position P(v) is above the interference position P1 by the deceleration moving angle P(x) that is obtained by the following calculation formula.

$$P(x)=v\div 60\times 360\div 1000\times T(v)\div 2=(3\times v\times T(v))\div 1000$$

FIG. 6(*b*) shows a specific example of the feed velocity v and the deceleration time T(v) at the time of the sudden stop processing. For example, when the feed velocity v is 60 [$min^{-1}$] and the deceleration time T(v) is 120 [ms], the deceleration moving angle P(x) has the following value.

$$P(x)=60\div 60\times 360\div 1000\times 120\div 2=21.6°$$

When the interference position P1 is 160°, the interference check position P(v) is expressed as follows.

$$P(v)=P1-P(x)$$

Therefore, when the deceleration moving angle P(x) is 21.6°, the interference check position P(v) is expressed as follows.

$$P(v)=160-21.6=138.4°$$

Further, for example, when the feed velocity v is 30 [$min^{-1}$] and the deceleration time T(v) is 60 [ms], the deceleration moving angle P(x) has the following value.

$$P(x)=30\div 60\times 360\div 1000\times 60\div 2=5.4°$$

When the interference position P1 is 160° and the deceleration moving angle P(x) is 5.4°, the interference check position P(v) has the following value.

$$P(x)=160-5.4=154.6°$$

As indicated by black or oblique lines in FIG. 6(*b*), the deceleration moving angle P(x), which is the interference timing set value, is an area of a triangle in the graph of the time t and the feed velocity v. Note that although it has been explained that the second value is for the deceleration moving angle, when the second value is actually set, the value may be a value to which a slight margin, such as 10 ms, for example, is added in consideration of safety.

As described above, the controller 314 calculates the release start timing, the release end timing, the feed timing, and the interference timing as the positions of the slide 312 at the respective timings. FIG. 5(*c*) is a diagram showing a relation among the rotation of the crankshaft 308, the control operations (the release, the feed, and the interference) of the leveler feeder 200, and the operation of the press machine 300 (the stamping (a dashed line)), which also shows an upper dead center and the bottom dead center.

(Automatic Setting of Timings and Position Switches)

Figures 7A, 7B:
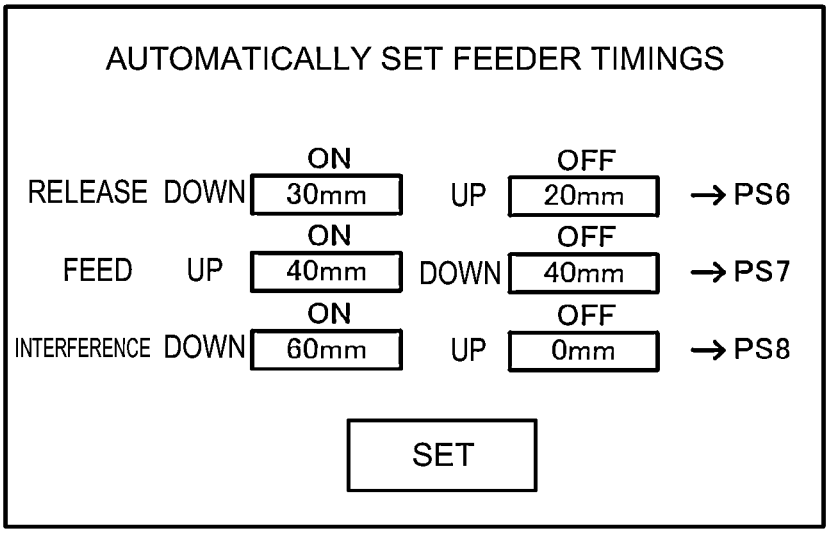
FIG. 7(*a*) is a diagram showing information displayed after each timing is calculated, and FIG. 7(*b*) is a diagram showing information in which the calculated each timing is set to a position switch of the embodiment.

FIG. 7(*a*) is a diagram showing information displayed, for example, on the display unit 316 after the respective timings of the present embodiment described above are calculated, and FIG. 7(*b*) is a diagram showing information in which the respective calculated timings are set to position switches. FIG. 7(*a*) shows a result in which the controller 314 determines the stamping start and the stamping end based on the load waveform acquired from the result of detection of the sensor 324 in the one stamping press, and the respective timings, which are determined from the timings of the stamping start and the stamping end, are automatically set as the positions of the slide 312. Note that a "down" and an "up" in FIG. 7(*a*) indicate a state of the vertical movement of the slide 312, and a "PS6" and the like indicate the position switches. The controller 314 causes the display unit 316 to display such a screen. If the values calculated by the controller 314 are acceptable, a "set" button is clicked to store the values in the storage unit 315, for example.

Further, the controller 314 stores the set values of FIG. 7(*a*) in the storage unit 315 as set values of software-like switches (hereinafter referred to as the position switches), in association with a program for controlling the press die 303 and the stamping operation by the press die 303. As a result, when the same press die 303 or the same program is used next time, the controller 314 can read out the set values stored in the storage unit 315 to perform the respective timing controls, which makes it unnecessary to make manual adjustments every time the press die 303 is changed or the program is called. FIG. 7(*b*) shows an example in which the set values, which are obtained by an automatic calculation of the present embodiment for a predetermined press die X, are set as position switches "PS1" to "PS8".

For example, in FIG. 7(*a*), as a result of an analysis of the load waveform by the controller 314, the position of the descending slide 312 is set be the release start timing (ON) at a position 30 mm away from a reference position (for example, 0 mm), and the position of the ascending slide 312 is set to be the release end timing (OFF) at a position 20 mm away from the reference position at which. The set values relating to the release are stored in the position switch "PS6". For example, the set values relating to the release are stored as shown by the "PS6" in FIG. 7(*b*). The same applies to the feed (the position switch "PS7") and the interference (the position switch "PS8").

As described above, in the present embodiment, it is possible to automatically set the various timings when the press machine 300 and the leveler feeder 200 are coordinated to perform the stamping. Therefore, it is possible to perform the setting without repeating a series of adjustments several times that have been manually performed in the past. Further, the frequency of manual input is also reduced. Furthermore, since it is also possible to reflect the set values as the software-like position switches, when the same press die or program is used, it is possible to call and use the information stored in the storage unit from the second time onward.

Note that when the press system is operated at high speed, the conveyance time (the feed time) for the same distance is shorter than when the press system is operated at the standard feed velocity. As a result, the rotational speed in the stamping press increases. When the feed timing set value and the interference timing set value are set as the positions of the slide 312, these values are constant values regardless of the feed velocity. However, it is also possible to enable the calculated set values to be further adjusted by using the screen shown in FIG. 7(*a*).

Further, in the present embodiment, the release start/end timings of the feed rolls 220 have been described, but release start/end timings of the work rolls 210 may further be calculated. Due to a structure of the work rolls 210 (see FIG. 1), the time for the work rolls 210 to transition from the closed state to the open state is longer than the time for the feed rolls 220 to transition from the closed state to the open state. In other words, the work rolls 210 take longer for the release than the feed rolls 220. Conventionally, the release command from the press machine 300 to the leveler feeder 200 is output at the same time. However, by using the calculation method of the timings of the present embodiment, it is possible to separate between the release command to the feed rolls 220 and the release command to the work rolls 210. In this manner, by outputting the release command to the feed rolls 220 and the release command to the work rolls 210 at different timings, a difference in time required for the release can be absorbed. As a result, shortening of the release time can be achieved as a whole. Then, if the shortening of the release time can be achieved, it is possible to increase the rotational speed in the stamping press in the press machine 300. As described above, the controller 314 may determine, based on the result of detection by the sensor 324 and the length L of the pilot pin 352, the second timing at which the work rolls 210 are switched from the closed state to the open state, the second timing being a timing different from the first timing in the feed rolls 220.

Although the preferred embodiment of the present invention has been described above, the present invention is not limited to these, and various modifications and changes are possible within the scope of the summary, such as the following modifications, for example.

In the embodiment described above, the pilot hole 122 is pierced by the punch 350 in the scrap portion of the coil material 120 in the stamping stage St1, but the present invention is not limited to this. For example, the pilot pin 352 may be inserted into a hole to be subjected to the stamping for a product.

Further, in the embodiment described above, the pilot pins 352 have the same length, but they may have different lengths in accordance with the stamping in the respective stamping stages. In this case, for example, the release start/end timing may be determined based on the most severe condition, that is, the length of the longest pilot pin among the plurality of pilot pins. Furthermore, in the embodiment described above, the controller 314 of the press machine 300 calculates the respective timings, but the present invention is not limited to this. For example, the control unit 230 of the leveler feeder 200 may receive necessary information such as the length L of the pilot pin 352 from the controller 314, and calculate the respective timings. In this manner, the controller 314 and the control unit 230 may each process all or a part of the controls described above. The information required for the controls described above may be stored in either of the storage units 315 and 235.

As described above, according to the present embodiment, it is possible to provide a press system and a control method of the press system that can automatically set a timing for coordinating a press machine and a feeding device.

REFERENCE SINGS LIST

100 Uncoiler
110 Mandrel
116 Display unit
120 Coil material
122 Pilot hole
130 Control unit
140 Driving unit
200 Leveler feeder
210 Work roll
220 Feed roll
230 Control unit
235 Storage unit
240, 250 Cylinders
260, 270 Motors
300 Press machine
302 Housing
303 Press die
303*a* Upper die
303*b* Lower die
304 Drive motor
306 Transmission mechanism
308 Crankshaft
310 Connecting rod
312 Slide
314 Controller
315 Storage unit
316 Display unit
318 Input unit
322 Bolster
324 Sensor
325 Rotary encoder
326 Guide gib
350 Punch
352 Pilot pin
360 Die
362 Die

The invention claimed is:

1. A press system comprising:

a holding device configured to hold a coil material;

a press machine configured to perform progressive stamping press in which several stamping actions are performed in a plurality of stages; and a feeding device configured to feed the coil material held by the holding device to the press machine, wherein the feeding device includes rolls configured to convey the coil material to the press machine in a closed state in which the coil material is clamped therebetween and be brought into an open state in which the coil material is released when stamping by the press machine is started, the press machine includes:

load detection means configured to detect a load at a time of the stamping;

a pin configured to be inserted into a hole pierced in the coil material for positioning at the time of the stamping; and control means configured to control the feeding device and the press machine to perform the stamping in coordination with each other, and the control means which controls the feeding device for switching the rolls from the closed state to the open state at a timing before the load is detected by the load detection means, wherein the timing is based on a length of the pin.

2. The press system according to claim 1, wherein the control means determines that the stamping is started when the load detection means starts to detect a load, and determines that the stamping is ended when the load detection means no longer detects the load.

3. The press system according to claim 2, wherein the press machine includes:

press dies including an upper die and a lower die to perform the stamping to the coil material; and a slide configured to vertically move with the upper die being attached thereto, and the control means sets a first timing, at which the rolls are switched from the closed state to the open state before the stamping is started, to a timing at which a height when the slide is descending is a height obtained by adding a height of the pin to a height when the stamping is started.

4. The press system according to claim 3, wherein the control means sets a timing, at which the rolls are switched from the open state to the closed state, to a timing at which a height when the slide is ascending is a height when the stamping is ended.

5. The press system according to claim 4, wherein the control means sets a timing, at which conveyance of the coil material is started by the rolls after the stamping is ended, to be later than a timing at which the rolls are switched from the open state to the closed state.

6. The press system according to claim 5, wherein the control means sets the timing, at which the conveyance of the coil material is started by the rolls after the stamping is ended, to a timing obtained by adding a first value to a position of the slide when the stamping is ended.

7. The press system according to claim 6, wherein the control means outputs a signal when the pin and the coil material are likely to interfere with each other in a state in which the conveyance of the coil material by the rolls is not ended, and sets a timing, at which the signal is output, to a timing obtained by adding a second value to a position of the slide at the first timing.

8. The press system according to claim 6, wherein the control means outputs a signal when the pin and the coil material are likely to interfere with each other in a state in which the conveyance of the coil material by the rolls is not ended, and sets a timing, at which the signal is output, to a timing obtained by adding a second value including the length of the pin to a position of the slide at a timing at which the stamping is started.

9. The press system according to claim 3, wherein the feeding device includes work rolls arranged on an upstream side of the rolls in a conveying direction of the coil material, and is brought into the closed state to straighten the coil material and brought into the open state to release the coil material, and the control means determines, based on a result of detection by the load detection means and the length of the pin, a second timing at which the work rolls are switched from the closed state to the open state, the second timing being a timing different from the first timing.

10. A control method of a press system, the press system including a holding device configured to hold a coil material, a press machine configured to perform progressive stamping press in which several stamping actions are performed in a plurality of stages, and a feeding device configured to feed the coil material held by the holding device to the press machine, wherein the feeding device includes rolls configured to convey the coil material to the press machine in a closed state in which the coil material is clamped therebetween and be brought into an open state in which the coil material is released when stamping by the press machine is started, the press machine includes;

load detection means configured to detect a load at a time of the stamping;

a pin configured to be inserted into a hole pierced in the coil material for positioning at the time of the stamping; and control means configured to control the feeding device and the press machine to perform the stamping in coordination with each other, and the control method includes controlling, by the control means, the feeding device for switching the rolls from the closed state to the open state at a timing before the load is detected by the load detection means, wherein the timing is based on a length of the pin.

* * * * *